US007609205B2

(12) United States Patent
Haskell

(10) Patent No.: US 7,609,205 B2
(45) Date of Patent: Oct. 27, 2009

(54) ELECTRICALLY STEERABLE PHASED ARRAY ANTENNA SYSTEM

(75) Inventor: Philip Edward Haskell, Hampshire (GB)

(73) Assignee: Qinetiq Limited (GB)

( * ) Notice: Subject to any disclaimer, the term of this patent is extended or adjusted under 35 U.S.C. 154(b) by 0 days.

(21) Appl. No.: 11/914,083

(22) PCT Filed: May 5, 2006

(86) PCT No.: PCT/GB2006/001645

§ 371 (c)(1),
(2), (4) Date: Nov. 9, 2007

(87) PCT Pub. No.: WO2006/120397

PCT Pub. Date: Nov. 16, 2006

(65) Prior Publication Data

US 2008/0191940 A1 Aug. 14, 2008

(30) Foreign Application Priority Data

May 12, 2005 (GB) ..... 0509647

(51) Int. Cl.
*H01Q 3/00* (2006.01)

(52) U.S. Cl. ..... 342/368; 342/373

(58) Field of Classification Search ..... 342/81, 342/154, 354, 368, 372, 373; 343/814, 816, 343/850, 853

See application file for complete search history.

(56) References Cited

U.S. PATENT DOCUMENTS 4,652,880 A 3/1987 Moeller et al.

5,589,843 A 12/1996 Meredith et al.

FOREIGN PATENT DOCUMENTS

| | | |
|---|---|---|
| EP | 0 215 971 | 1/1987 |
| EP | 0 524 001 | 1/1993 |
| WO | WO03/036756 | 5/2003 |
| WO | WO03/036759 | 5/2003 |
| WO | WO03/043127 | 5/2003 |
| WO | WO2004/088790 | 10/2004 |
| WO | WO2004/102739 | 11/2004 |
| WO | WO2005/018043 | 2/2005 |

OTHER PUBLICATIONS

Skobelev, "Methods of Constructing Optimum Phased-Array Antennas for Limited Field of View", IEEE Antennas and Propagation Magazine, vol. 40, No. 2, pp. 39-50 (Apr. 1998).

*Primary Examiner*—Dao L Phan
(74) *Attorney, Agent, or Firm*—McDonnell Boehnen Hulbert & Berghoff LLP

(57) ABSTRACT

An electrically steerable phased array antenna system includes an array of antenna elements and a corporate feed network having an inner region for input of two input signals A and B. The corporate feed network has two outer regions and generating vector combinations of respective input signals and other input signal fractions. Each outer region has a splitting and combining network providing the vector combinations as signals to antenna elements connected predominantly peripherally to itself. Each splitting and combining network has input signal connections from the inner region disposed peripherally of the corporate feed network. Each consists of splitters and adding/subtracting elements implemented as hybrid couplers some of which have re-entrant or meandered track sections. Hybrid meandered track sections have multiple widths for signal weighting. The corporate feed network is configured to avoid track cross-overs.

14 Claims, 10 Drawing Sheets

138
12
S
170
H
134
11
136
164
10
S
H
106
S
132
120
H
8
162B
7
S
172
128w
100A
A
162
128n
128n
174
S
128

ELECTRICALLY STEERABLE PHASED ARRAY ANTENNA SYSTEM

BACKGROUND OF THE INVENTION (1) Field of the Invention

This invention relates to an electrically steerable phased array antenna system. It is intended for use in many areas, for example telecommunications and radar, but finds particular application in cellular mobile radio networks, commonly referred to as mobile telephone networks. More specifically, but without limitation, the antenna system of the invention may be used with second generation (2G) mobile telephone networks such as the GSM, CDMA (IS95), D-AMPS (IS136) and PCS systems, and third generation (3G) mobile telephone networks such as the Universal Mobile Telephone System (UMTS), and other cellular radio systems.

(2) Description of the Art

Cellular mobile radio networks which use phased array antennas are known: such an antenna comprises an array of individual antenna elements (usually eight or more) such as dipoles or patches. The antenna has a radiation pattern consisting of a main lobe and sidelobes. The centre of the main lobe is the antenna's direction of maximum sensitivity, i.e. the direction of its main radiation beam. It is a well known property of a phased array antenna that if signals received by antenna elements are delayed by a delay which varies linearly with element distance from an edge of the array, then the antenna main radiation beam is steered towards the direction of increasing delay. The angle between main radiation beam centres corresponding to zero and non-zero variation in delay, i.e. the angle of steer, depends on the rate of change of delay with distance across the array.

Delay may be implemented equivalently by changing signal phase, hence the expression phased array. The direction of the main beam of an antenna pattern can therefore be altered by adjusting the phase relationship between signals fed to different antenna elements. This allows the beam to be steered to modify the coverage area of the antenna.

Operators of phased array antennas in cellular mobile radio networks have a requirement to adjust their antennas' vertical radiation pattern, i.e. the pattern's cross-section in the vertical plane. This is necessary to alter the vertical angle of the antenna's main beam, also known as the "tilt", in order to adjust the ground coverage area of the antenna. Such adjustment may be required, for example, to compensate for change in cellular network structure or number of base stations or antennas. Adjustment of antenna angle of tilt is known both mechanically and electrically, and both individually and in combination.

Control of an antenna's angle of electrical tilt is disclosed in International Patent Application Nos. WO 03/036756, WO 03/036759, WO 03/043127, WO 2004/088790 and WO 2004/102739. Of these, WO 2004/102739 in particular discloses control of electrical tilt by varying a phase difference between a pair of signals: a signal splitting and recombining network forms a set of different vectorial combinations of these signals with appropriate phasing for input to respective antenna elements.

However, WO 2004/102739 suffers from the disadvantage that it employs track cross-overs, i.e. circuit regions providing for one signal to cross another. Track crossovers require either a three-dimensional circuit (multilayer design) or a two-dimensional circuit incorporating track cross-over networks. The three dimensional approach increases circuit size and bulk: it requires a large radome and results in high cost. A planar printed circuit approach can reduce circuit size and cost, but the resulting need to employ cross-over networks significantly increases signal losses and reduces the gain of the antenna. Use of a significant number of hybrids and cross-over networks also reduces the bandwidth over which the antenna gain beam pattern can be maintained.

SUMMARY OF THE INVENTION

It is an object of the present invention to provide an alternative form of electrically tiltable phased array antenna system.

The present invention provides an electrically steerable phased array antenna system including an array of antenna elements and a corporate feed network having:

a) an inner region arranged for input of two input signals;

b) two outer regions for generation of vector combinations of proportions of one respective input signal plus and minus fractions of the other input signal; and c) in each outer region a respective splitting and combining network arranged to provide the said vector combinations as output signals to antenna elements connected at least predominantly peripherally to itself, each splitting and combining network having respective input signal connections from the inner region disposed largely peripherally of the corporate feed network and being arranged in combination with the input signal connections to avoid track cross-overs.

The invention provides the advantage that it avoids track cross-overs: in specific embodiments, the invention also makes it possible to achieve the following additional advantages:

a) connecting jumper cables to signal inputs may be the same length to maintain phase neutrality without being undesirably long;

b) the splitting and combining networks may be used to define two separate output groups each feeding a respective half of the phased array antenna, and each located in a way which facilitates connections between the corporate feed network and the phased array antenna without requiring undesirably long leads which result in higher loss; and c) the locations of the output groups make it possible to connect them to the phased array antenna with relatively thick, low-loss, jumper cables: this is because the corporate feed network may be fitted into a radome accommodating the phased array antenna without requiring sharp cable bends; i.e. a small minimum bend radius (associated with a relatively thinner cable) is not required.

The splitting and combining networks may extend transversely of the corporate feed network and be longitudinally separated from the inner region. They may have splitters and adding and subtracting elements implemented as four port couplers, and may include an adding and subtracting element which is rectangular but not re-entrant. The four port couplers may be 180 degree hybrids. At least some of the hybrids may have re-entrant or meandered track sections, and the meandered track sections may have multiple widths to implement signal weighting The antenna system may include signal connections with meandered portions to implement fixed phase shifts.

The corporate feed network may implemented as a circuit board and the splitters and adding and subtracting elements may be connected by conducting tracks with centres separated by at least $\lambda/8$ from one another, where $\lambda/8$ is a wavelength of operation in the circuit board material. Input signal connections to the splitting and combining networks may be conducting tracks with centres which are distant x from respective outer edges of the circuit board, where $\lambda/10 \leqq x \leqq \lambda/$ 8. These conducting tracks may have centres which are between 8.4 mm and 10.5 mm from the outer edges of the circuit board.

In another aspect, the present invention provides a method of producing antenna element drive signals for an electrically steerable phased array antenna system including an array of antenna elements and a corporate feed network, the method having the steps of:

a) feeding two input signals with variable relative phase to an inner region of the corporate feed network; and b) generating vector combinations of proportions of one respective input signal plus and minus fractions of the other input signal in two outer regions of the corporate feed network each having a respective splitting and combining network arranged to provide the said vector combinations as output signals to antenna elements connected at least predominantly peripherally to itself, each splitting and combining network having respective input signal connections from the inner region disposed largely peripherally of the corporate feed network and being arranged in combination with the input signal connections to avoid track cross-overs.

The splitting and combining networks may have splitters and adding and subtracting elements implemented as 180 degree hybrids at least some of which have re-entrant or meandered track sections.

In order that the invention might be more fully understood, embodiments thereof will now be described, by way of example only, with reference to the accompanying drawings, in which:

DESCRIPTION OF A PREFERRED EMBODIMENT

Figure 1:
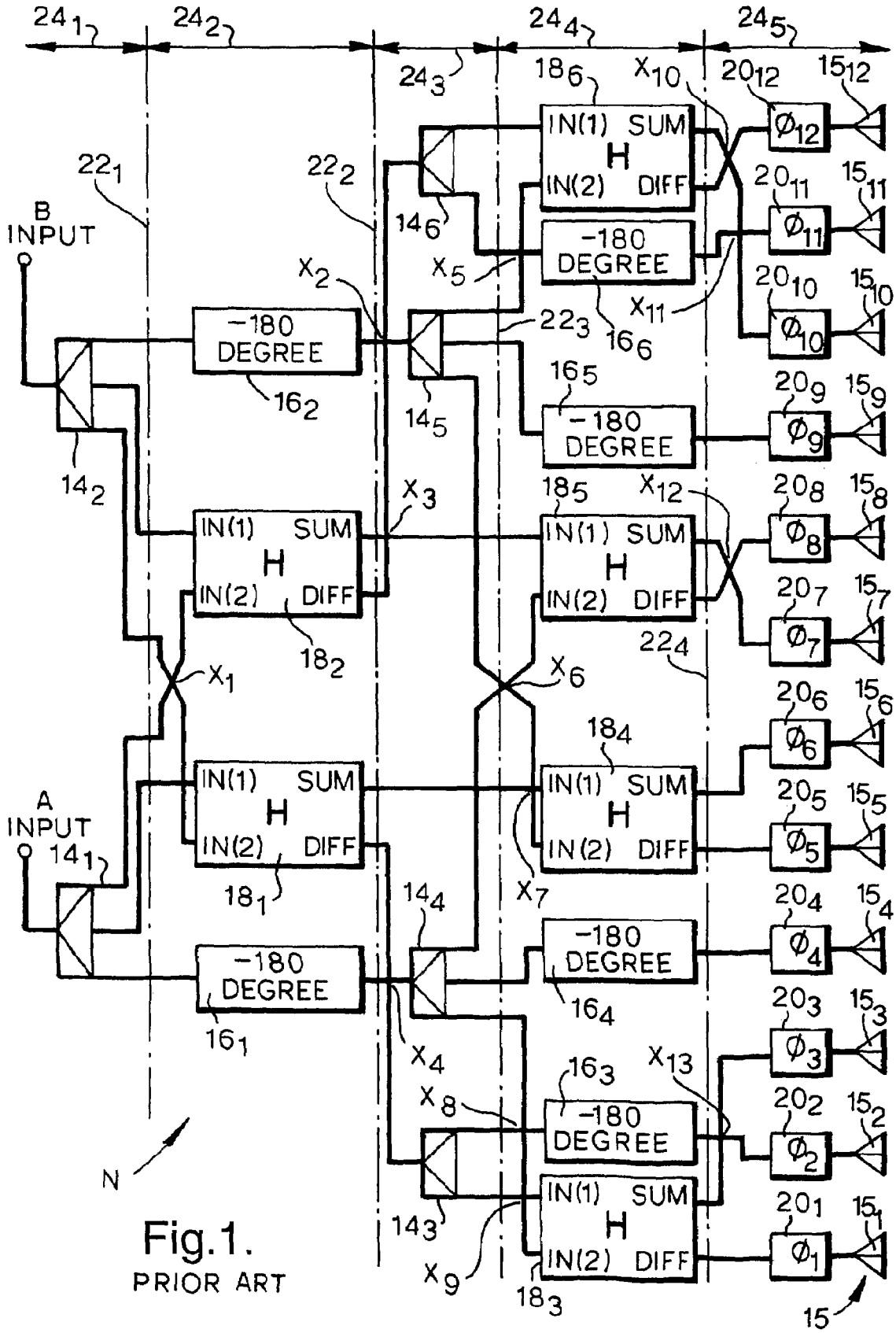
Fig.1. PRIOR ART
FIG. 1 illustrates a prior art corporate feed network for a phased array antenna having an adjustable angle of electrical tilt.

Referring to FIG. 1, there is shown a prior art signal feed network N of the kind disclosed by WO 2004/102739. The network N supplies drive signals to a phased array antenna 15 having twelve elements $\mathbf{15}_1$ to $\mathbf{15}_{12}$. First and second splitters $\mathbf{14}_1$ and $\mathbf{14}_2$ receive vector input signals A and B of equal power but variable phase relative to one another at inputs A and B respectively. Each splitter $\mathbf{14}_1/\mathbf{14}_2$ divides its input signal into three output signals. One signal from each splitter $\mathbf{14}_1/\mathbf{14}_2$ passes to a first or second −180 degree phase shifter $\mathbf{16}_1/\mathbf{16}_2$. A second signal from each splitter $\mathbf{14}_1/\mathbf{14}_2$ passes to a respective input IN(1)/IN(2) of a first 180 degree hybrid directional coupler (hybrid) $\mathbf{18}_1$ (90 degree hybrids can be used instead but required additional provision to equalise electrical lengths of or phase shifts in different paths). A third signal from each splitter $\mathbf{14}_1/\mathbf{14}_2$ passes to a respective input IN(1)/IN(2) of a second hybrid $\mathbf{18}_2$. The hybrids $\mathbf{18}_1$ and $\mathbf{18}_2$ have two outputs Sum and Diff at which the sum and difference of their input signals appear respectively.

The network has four additional splitters $\mathbf{14}_3$ to $\mathbf{14}_6$, two of which divide difference output signals from respective hybrids $\mathbf{18}_1/\mathbf{18}_2$ into two. The other two additional splitters $\mathbf{14}_5$ and $\mathbf{14}_6$ divide output signals from respective −180 degree phase shifters $\mathbf{16}_1/\mathbf{16}_2$ into three.

The network N has four additional −180 degree phase shifters $\mathbf{16}_3$ to $\mathbf{16}_6$ and four additional hybrids $\mathbf{18}_3$ to $\mathbf{18}_6$ which receive as inputs respective signals from the additional splitters $\mathbf{14}_3$ to $\mathbf{14}_6$ and from Sum outputs of the first and second hybrids $\mathbf{18}_1$ and $\mathbf{18}_2$. The additional hybrids $\mathbf{18}_3$ to $\mathbf{18}_6$ function in the same way as the first and second hybrids $\mathbf{18}_1$ and $\mathbf{18}_2$. The signals from the additional phase shifters $\mathbf{16}_3$ to $\mathbf{16}_6$ and from Sum and Diff outputs of the additional hybrids $\mathbf{18}_3$ to $\mathbf{18}_6$ pass via respective fixed phase shifters $\mathbf{20}_1$ to $\mathbf{20}_{12}$ to the antenna elements $\mathbf{15}_1$ to $\mathbf{15}_{12}$ respectively.

As described in detail in WO 2004/102739, the content of which is incorporated herein for reference purposes, the network N provides signals with appropriate relative phasing to form an output beam from the antenna array 15. Electrical tilt of this beam is adjusted by varying the phase difference between the two input signals A and B. The general effect produced by splitting, adding and subtracting signals in the network N are that signals reaching the ith antenna element $\mathbf{15}_i$ in the lower half of the array 15 (i.e. i=1 to 6) receive inputs of the normalised form $g_iA \pm f_iB$, where $0<g_i \leqq 1$ and $0 \leqq f_i<1$. In addition, signals reaching the ith antenna element $\mathbf{15}_i$ in the upper half of the array 15 (i.e. i=7 to 12) receive inputs of the normalised form $g_iB \pm f_iA$. These antenna element signals have phases relative to one another appropriate for a phased array.

However, the network N suffers from the disadvantage that it employs track crossovers, i.e. circuit regions providing for one signal to cross another. Track cross-overs are indicated at $X_1$ to $X_{13}$. The network N can be treated as five functional sections in series as delimited by vertical dotted lines $\mathbf{22}_1$ to $\mathbf{22}_4$, and indicated in extent by bidirectional arrows $\mathbf{24}_1$ to $\mathbf{24}_5$. It has crossovers $X_1$ etc. in four of these sections and fourteen cross-overs in total. As has been said, track cross-overs deleteriously affect either size and cost or performance depending on how they are implemented.

Figure 2:
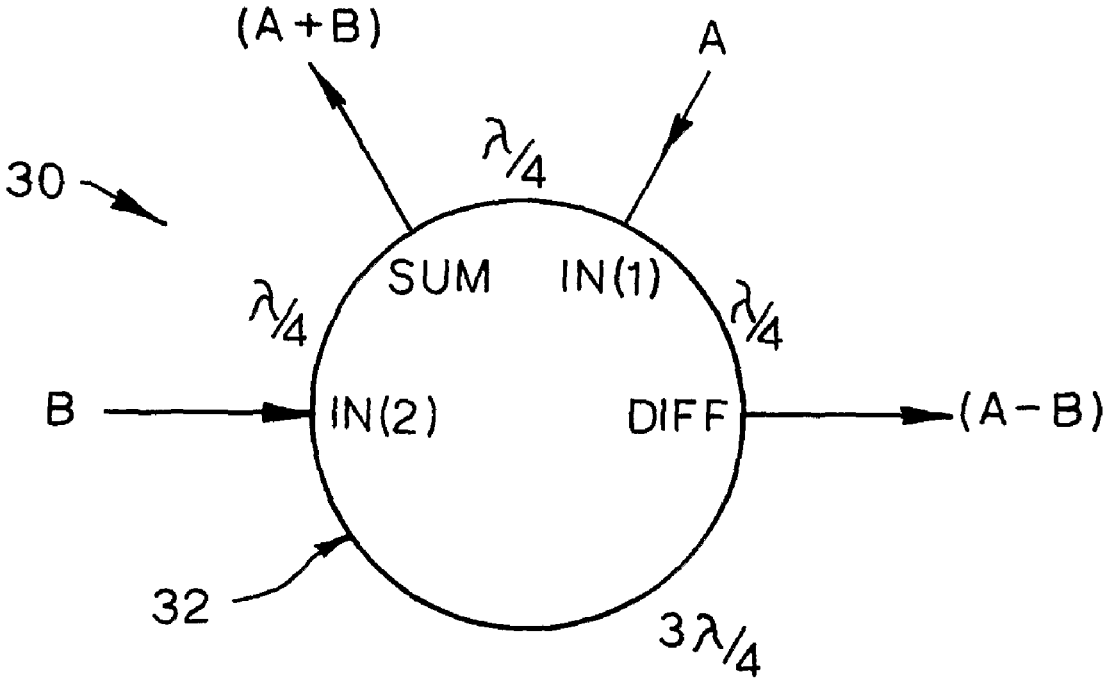
FIGS. 2 and 3 provide schematic drawings of 180 hybrid couplers.
Figure 2:
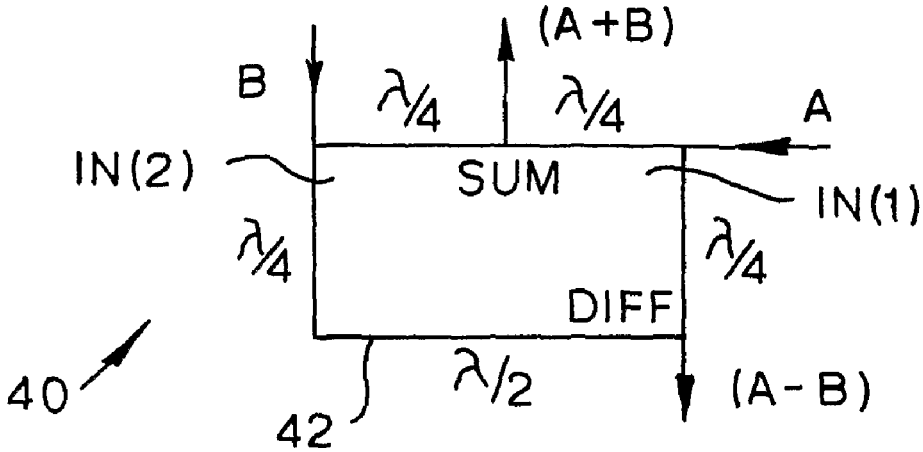

Referring now to FIG. 2, two implementations of hybrids are shown schematically. These are so-called 180 degree hybrids with four ports, i.e. two input ports and two output ports: a signal at one input appears in phase at both outputs, whereas a signal at the other input appears in phase at one output but in antiphase at the other. Consequently the outputs add at one output and subtract at the other. The outputs therefore provide sum and difference vectors of the hybrid's input signal vectors. A first hybrid 30 comprises a circular conductor or track 32 of length $3\lambda/2$ with first and second signal inputs IN(1) and IN(2) spaced apart from one another by $\lambda/2$, where $\lambda$ is signal wavelength in the waveguide provided by the track 32 and its support material (not shown). A sum output Sum is located between and equispaced from the two inputs IN(1) and IN(2), the spacing being $\lambda/4$ measured around the track 32. A difference output Diff is spaced by $\lambda/4$ from the first input IN(1) and by $3\lambda/4$ from the first second IN(2), spacing being measured around the track 32 as before. As will be described later, weightings can be applied to signals within the track 32 by altering its width: e.g. with input signals A and B, instead of a sum output (A+B) one can obtain (xA+yB), and instead of a difference output (A−B) one can obtain (yA−xB); here x and y are scalars, and $x^2+y^2=1$ for conservation of power flowing through the hybrid, ignoring small unavoidable losses due to non-ideal hybrid properties.

Signals A and B input at the first and second signal inputs IN(1) and IN(2) respectively have like path differences and therefore zero phase shift relative to one another when they reach the sum output Sum, and they therefore add to form (A+B). These signals have a path difference of λ/2 and therefore 180 degrees phase shift relative to one another when they reach the difference output Diff, and they therefore subtract to form (A−B). The circular hybrid 30 has marginally superior frequency response to rectangular and re-entrant hybrids to be described later, but requires more circuit area.

A second hybrid 40 comprises a rectangular track 42 of horizontal length λ/2 and vertical width λ/4 giving a total length 3λ/2 around its perimeter. It has first and second signal inputs IN(1) and IN(2) at opposite upper vertices of the rectangular track 42 and therefore spaced apart from one another by λ/2. A sum output Sum is located midway between the two inputs IN(1) and IN(2) and spaced from each of them by λ/4. A difference output Diff is located at a lower right vertex: it is consequently spaced by λ/4 from the first input IN(1) and by 3λ/4 from the first second IN(2). The second hybrid 40 therefore has signal path lengths equivalent to those of the first hybrid 30, but its rectangular implementation may be more convenient in a printed circuit.

Figure 3:
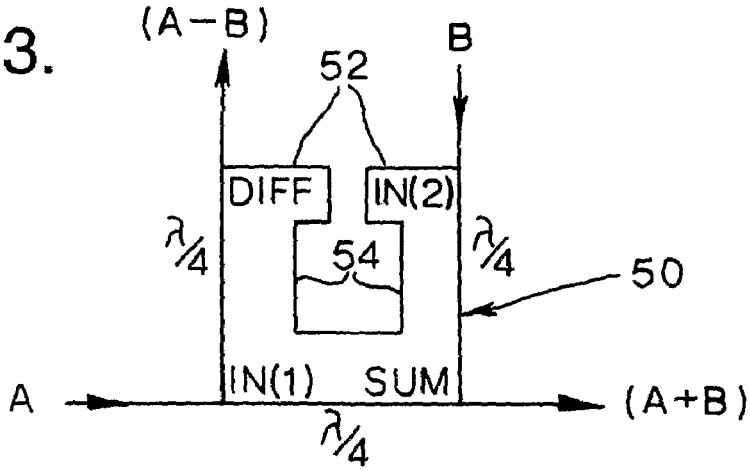
Figure 3:
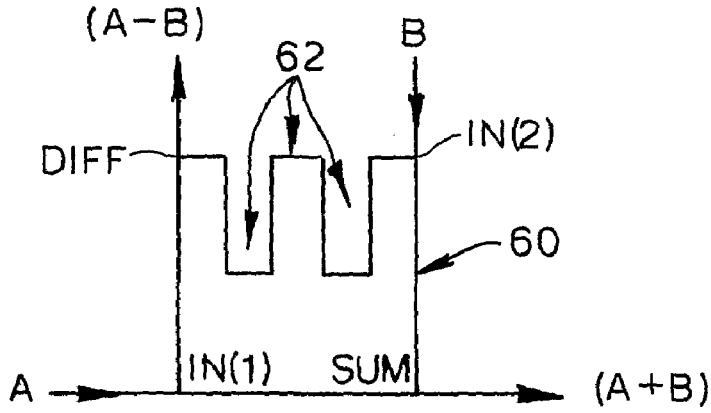
Figure 3:
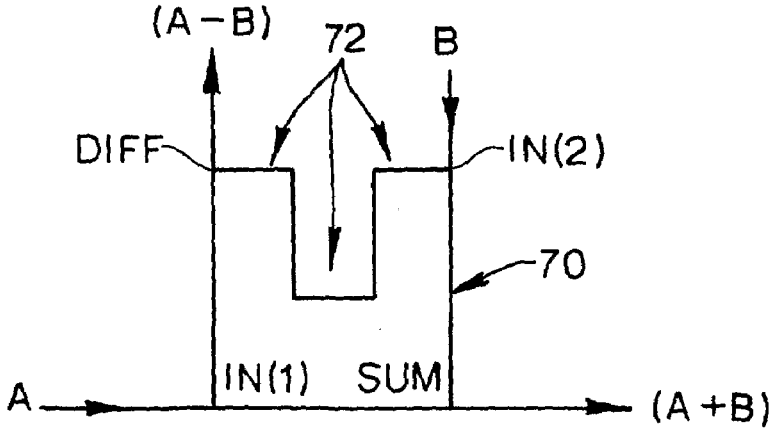

Referring now to FIG. 3, two further implementations of hybrids, i.e. third and fourth hybrids 50 and 60, are shown schematically: these hybrids are constructed in re-entrant form to reduce their horizontal dimensions and consequently to reduce also the circuit area they require. The third hybrid 50 is generally square in outline with sides λ/4 in length. This provides for first and second inputs IN(1) and IN(2) at lower left and upper right vertices to be equispaced by λ/4 from a sum output Sum at a lower right vertex. An upper side 52 has a re-entrant conductor section 54 (not shown to scale) which provides a total path length of 3λ/4 between the second input IN(2) at the upper right vertex and a difference output Diff at an upper left vertex.

The fourth hybrid 60 is equivalent to the third hybrid 50 with upper side 52 and re-entrant section 54 replaced by a meandered upper conductor section 62. Here again the fourth hybrid 60 has a total path length of 3λ/4 between a second input IN(2) at its upper right vertex and a difference output Diff at its upper left vertex by virtue of the meandered upper conductor section 62.

For simplification of the drawings, the re-entrant third and fourth hybrids 50 and 60 may be represented herein as shown at 70 in FIG. 3, although strictly speaking an upper U-shaped conductor 72 is (as illustrated) insufficiently long to provide total path length of 3λ/4 between a second input IN(2) and a difference output Diff.

Figure 4:
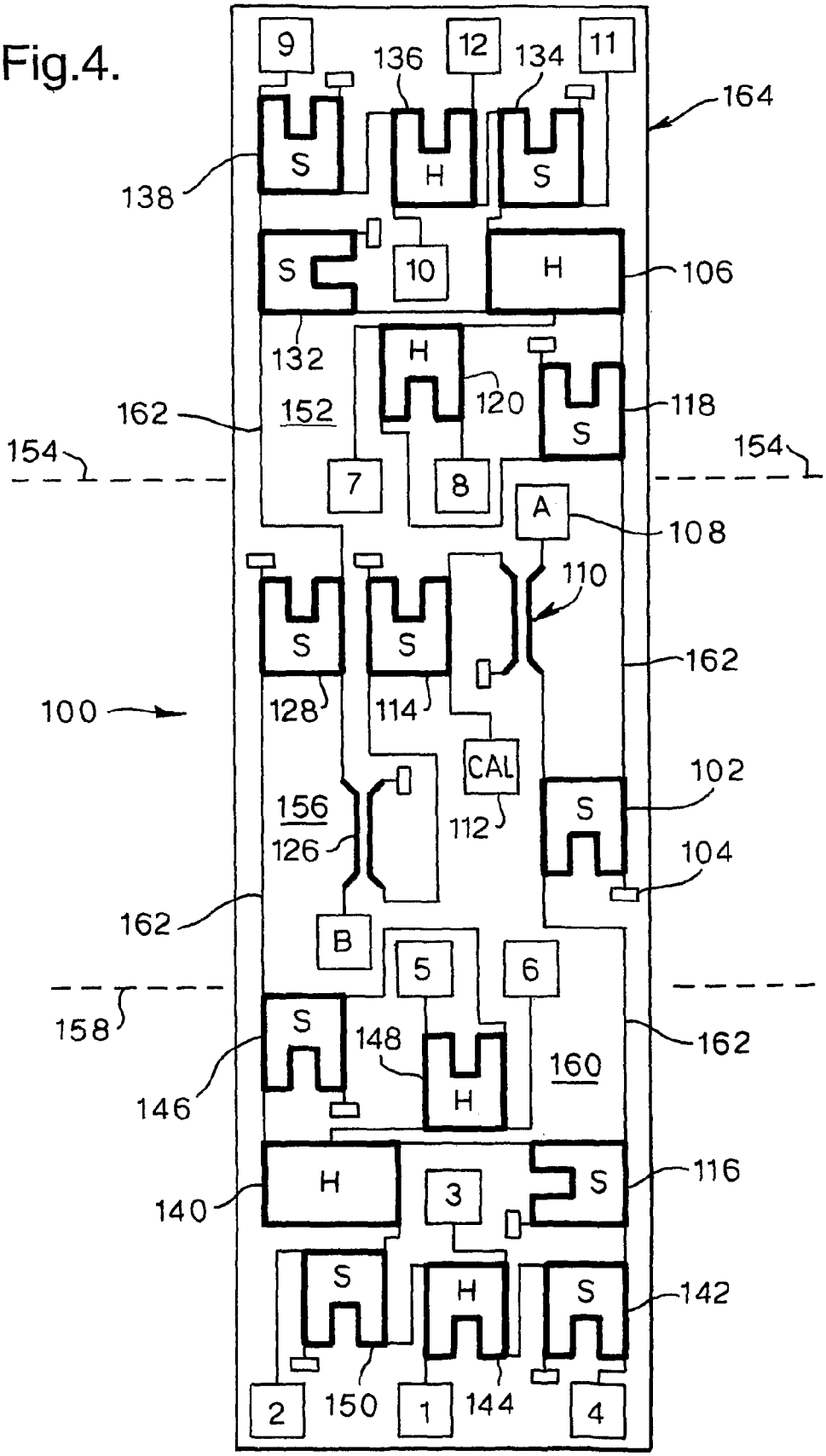
FIG. 4 is a corporate feed network of the invention using hybrids as in FIGS. 2 and 3.

FIG. 4 is a schematic drawing of a corporate feed network 100 for an electrically steerable phased array antenna system of the invention. It implements the vector functions provided by network N described with reference to FIG. 1, but avoids the use of cross-overs. It incorporates but does not show −180 degree phase shifters equivalent to phase shifters $\mathbf{16}_1$ to $\mathbf{16}_6$, these being implemented in practice by meandered lengths of conductor as will be described later. Splitters such as 102 are marked S and implemented as hybrids as shown at 70 in FIG. 3. These S hybrids have one input terminated by a resistor indicated by a small rectangle such as 104 and giving a zero signal: consequently signal B is zero and sum and difference outputs are equal, i.e. (A+B)=(A−B)=A. Hybrids such as 106 (as shown at 40 in FIG. 2) without a terminating resistor are marked H and act as vector sum and difference generators. Inputs and outputs of splitters and hybrids are not marked to reduce illustrational complexity, but can be inferred by comparison with FIGS. 2 and 3.

An A input signal at an input port 108 passes to a parallel line coupler 110 which taps off a small proportion (<0.1%, or −30 dB) for supply to a calibration output port 112 via a splitter 114. Most of the A input signal passes from the parallel line coupler 110 to two splitters 102 and 116 in cascade. The reason for using two splitters 102 and 116 instead of one lies in the fact that splitters are implemented by using one input only of a sum and difference hybrid, terminating the other, and setting its power dividing ratio by adjustment of widths of different parts of its track. Use of two splitters reduces individual splitter ratios and avoids the need for track widths which are too small or too large.

The combination of the two splitters 102 and 116 creates three split signals, one of which passes upwards to another splitter 118 which splits it into two A fraction signals for input to respective upper hybrids 106 and 120: these hybrids also receive other input signals as follows. A B input signal at an input port 124 passes to a second parallel line coupler 126 supplying the calibration output port 112 via the splitter 114. Most of the B input signal passes from the parallel line coupler 126 to successive splitters 128 and 132 in cascade, of which splitter 132 provides a second input to hybrid 106 which in turn provides a sum output as a second input to hybrid 120.

Hybrid 120 has sum and difference outputs connected to output ports indicated by squares 7 and 8 for connection to antenna elements corresponding in position to antenna elements $\mathbf{15}_7$ and $\mathbf{15}_8$ in FIG. 1. These and other antenna elements are not shown. Fixed phase shifts between output ports and respective antenna elements are implemented by lengths of cable (not shown): these phase shifts contribute to phase neutralisation, i.e. electrical lengths from the A input and the B input to respective antenna elements are the same and consequently do not introduce relative phase shifts between signals to different antenna elements. Phase neutralisation improves the range of frequencies over which a required antenna response is maintained.

Hybrid 106 also provides a difference output signal to another splitter 134, which divides this signal between a third upper hybrid 136 and an output port 11 for connection to an antenna element corresponding in position to antenna element $\mathbf{15}_{11}$.

The splitter 132 also provides an input signal to another splitter 138, which divides this signal to provide a second input to the third upper hybrid 136 and an output port 9 for connection to an antenna element (not shown) corresponding in position to antenna element $\mathbf{15}_9$. The third upper hybrid 136 has sum and difference outputs connected to output ports 10 and 12 for connection to antenna elements corresponding in position to antenna elements $\mathbf{15}_{10}$ and $\mathbf{15}_{12}$.

Of the three split versions of the A input signal created by the two cascaded splitters 102 and 116, the other two pass respectively as input signals to a first lower hybrid 140 and another splitter 142 respectively: the splitter 142 splits its input into two signals for input respectively to a second lower hybrid 144 and an output port 4 for connection to an antenna element corresponding in position to antenna element $\mathbf{15}_4$.

The splitter 128 also supplies a proportion of the B input signal to another splitter 146, which divides it to provide a second input signal to the first lower hybrid 140 and a first input signal to a third lower hybrid 148. The third lower hybrid 148 receives a second input signal from a sum output of the first lower hybrid 140, and has difference and sum outputs connected to output ports 5 and 6 for connection to antenna elements corresponding to antenna elements $\mathbf{15}_5$ and $\mathbf{15}_6$.

The first lower hybrid 140 also provides a difference output as an input signal to another splitter 150, which divides this signal between the second lower hybrid 144 and an output port 2 for connection to an antenna element corresponding to antenna element $\mathbf{15}_2$. The second lower hybrid 144 has difference and sum outputs connected to output ports 1 and 3 for connection to antenna elements corresponding to antenna elements $\mathbf{15}_1$ and $\mathbf{15}_3$.

Figure 5:
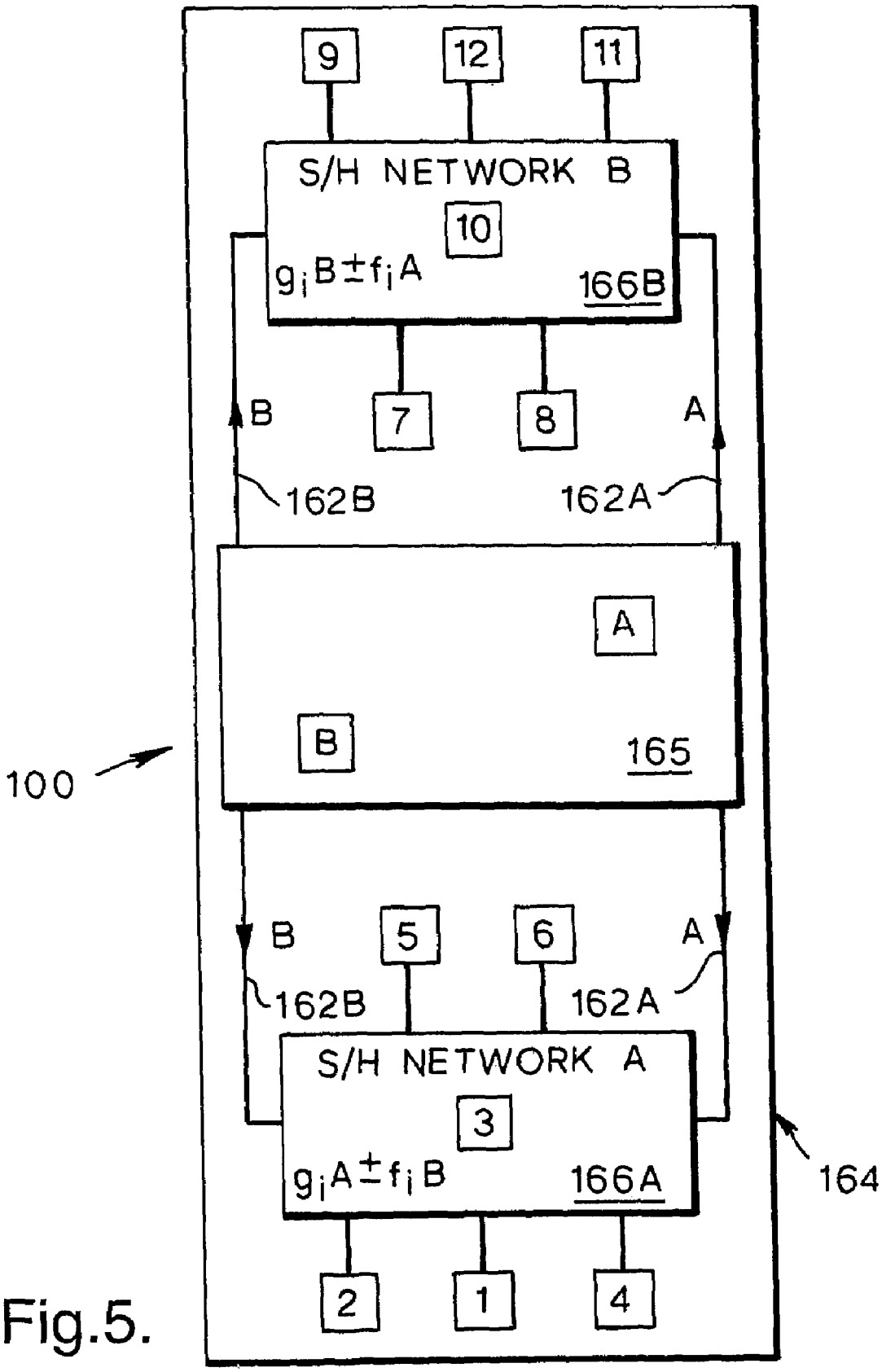
FIG. 5 is a generalised block diagram version of the corporate feed network of FIG. 4.

Referring now also to FIG. 5, a more generalised and relatively elongated form of the corporate feed network 100 illustrated in FIG. 4 is shown to indicate its main features more clearly. Parts previously described are like-referenced. In FIG. 4, the corporate feed network 100 has no track cross-overs. It avoids these cross-overs as follows: it has three regions, an upper or first outer region 152 above chain lines 154, a central or inner region 156 between chain lines 154 and 158, and a lower or second outer region 160 below further chain lines 158. The three regions are mounted upon a circuit board 164.

The input signals A and B are fed to the inner region input ports A and B from a direction out of the network's plane. They are split into individual signal fractions by a central splitting network 165 defined by central region elements 102, 110, 114, 126 and 128, which provide A and B signal feeds on conducting tracks 162B (signal B) and 162A (signal A) leading upwards and downwards respectively.

Elements 106, 118, 120 and 132 to 138 are within the upper region 152, and they collectively define an upper splitter/hybrid (S/H) network 166B in FIG. 5: above this S/H network 166B output ports 9, 11 and 12 are located, below it output ports 7 and 8, and within it output port 10. In other words five of the six upper output ports 7 to 12 are located peripherally of the upper S/H network 166B. One half (i.e. the upper half in FIG. 1) of the phased array of antenna elements (not shown) is connected to the upper output ports 7 to 12.

Similarly, elements 116 and 140 to 150 are within the lower region 160, and they collectively define a lower S/H network 166A in FIG. 5: above this S/H network 166A output ports 5 and 6 are located, below it output ports 1, 2 and 4, and within it output port 3: i.e. five of the six lower output ports 1 to 6 are located peripherally of the lower S/H network 166A, and one half (i.e. the lower half in FIG. 1) of the phased array of antenna elements is connected to lower output ports 1 to 6. As shown in FIG. 4, lower S/H network 166A is laterally inverted compared to upper S/H network 166B.

Signal fractions split from the input signals A and B by the central splitting network 165 are routed to the upper and lower S/H networks 166B and 166A upwards and downwards, i.e. generally outwardly from the central region 156 along the conducting tracks 162B and 162A near edges of the circuit board 164. When the A and B signal fractions reach the upper and lower S/H networks 166B and 166A they then pass inwardly and transversely of the board 164 into these networks; i.e. A signal fractions pass to the left and B signal fractions pass to the right. Because the S/H networks 166A and 166B are laterally inverted relative to one another, and because A and B signal fractions pass in opposite directions, the upper S/H network 166B generates antenna signals of the form $g_iB \pm f_iA$ and the lower S/H network 166A generates antenna signals of the form $g_iA \pm f_iB$, where $g_i$ and $f_i$ are fractions as described earlier.

The form of the corporate feed network 100 depends on how many antenna elements are required. An antenna array with eight antenna elements could employ a network with hybrids 136 and 144 and output ports 1, 3, 10 and 12 removed and splitter ratios adjusted appropriately for correct signal phasing. This would make all (instead of most) output ports located peripherally of one or other of the two splitter/hybrid networks referred to above because of the removal of centrally located output ports 3 and 10.

An antenna array with more than twelve antenna elements might require a network with more than one respective centrally located output port per splitter/hybrid network, but even then most of the output ports would be located peripherally of one or other of the two splitter/hybrid networks referred to above.

The corporate feed network 100 avoids track cross-overs by a combination of features as follows:

a) signal fractions are fed from the central splitting network 165 on conducting tracks 162B and 162A near outer edges of the circuit board 164: this enables these signal fractions to be subsequently routed transversely and inwardly to the upper and lower S/H networks 166B and 166A;

b) output ports 1 to 12 are at least predominantly located peripherally of the upper and lower S/H networks 166B and 166A;

c) the combination of features a) and b) allows signal fractions to pass down the board 164 longitudinally outwardly of the central splitting network 165, transversely inwardly of the S/H networks 166B and 166A and then peripherally of these S/H networks to output ports without cross-overs.

The corporate feed network 100 has further advantages in addition to avoidance of cross-overs:

a) connecting jumper cables to the A and B inputs can be the same length to maintain phase neutrality without being undesirably long;

b) output ports 1 to 12 are in two separate groups 1 to 6 and 7 to 12: this is advantageous because each group feeds a respective half of the antenna array; these output port groups are located in a way which facilitates connections between the network 100 and the antenna array without requiring undesirably long leads which result in higher loss; and c) the locations of the output ports 1 to 12 also make it possible to connect them to the antenna array with relatively thick, low-loss, jumper cables: this is because the network 100 can be fitted into a radome accommodating the antenna array without requiring sharp cable bends; i.e. a small minimum bend radius (associated with a relatively thinner cable) is not required.

Figure 6:
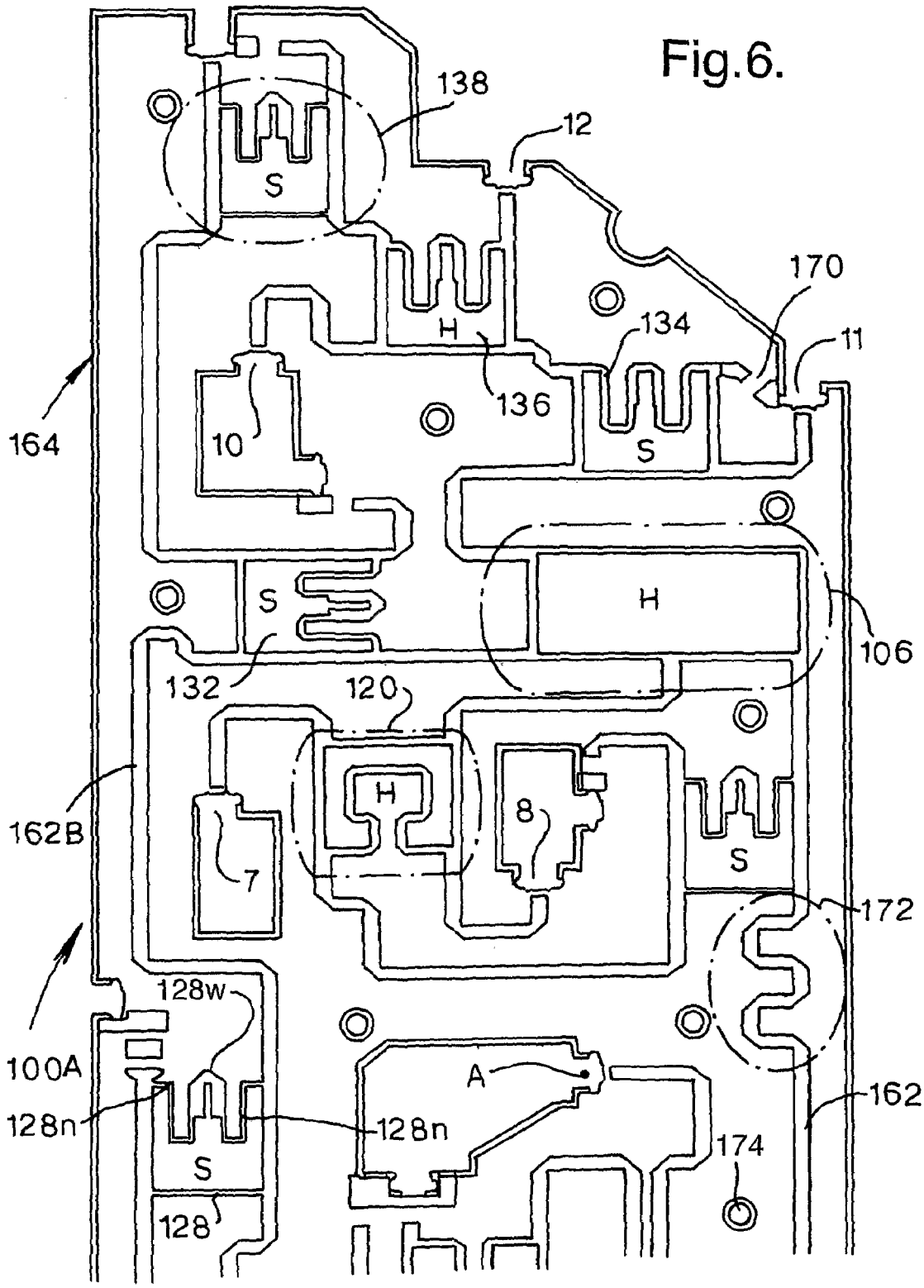
FIGS. 6 and 7 are scale drawings of parts of a circuit board implementation of the FIG. 4 network.
Figure 7:
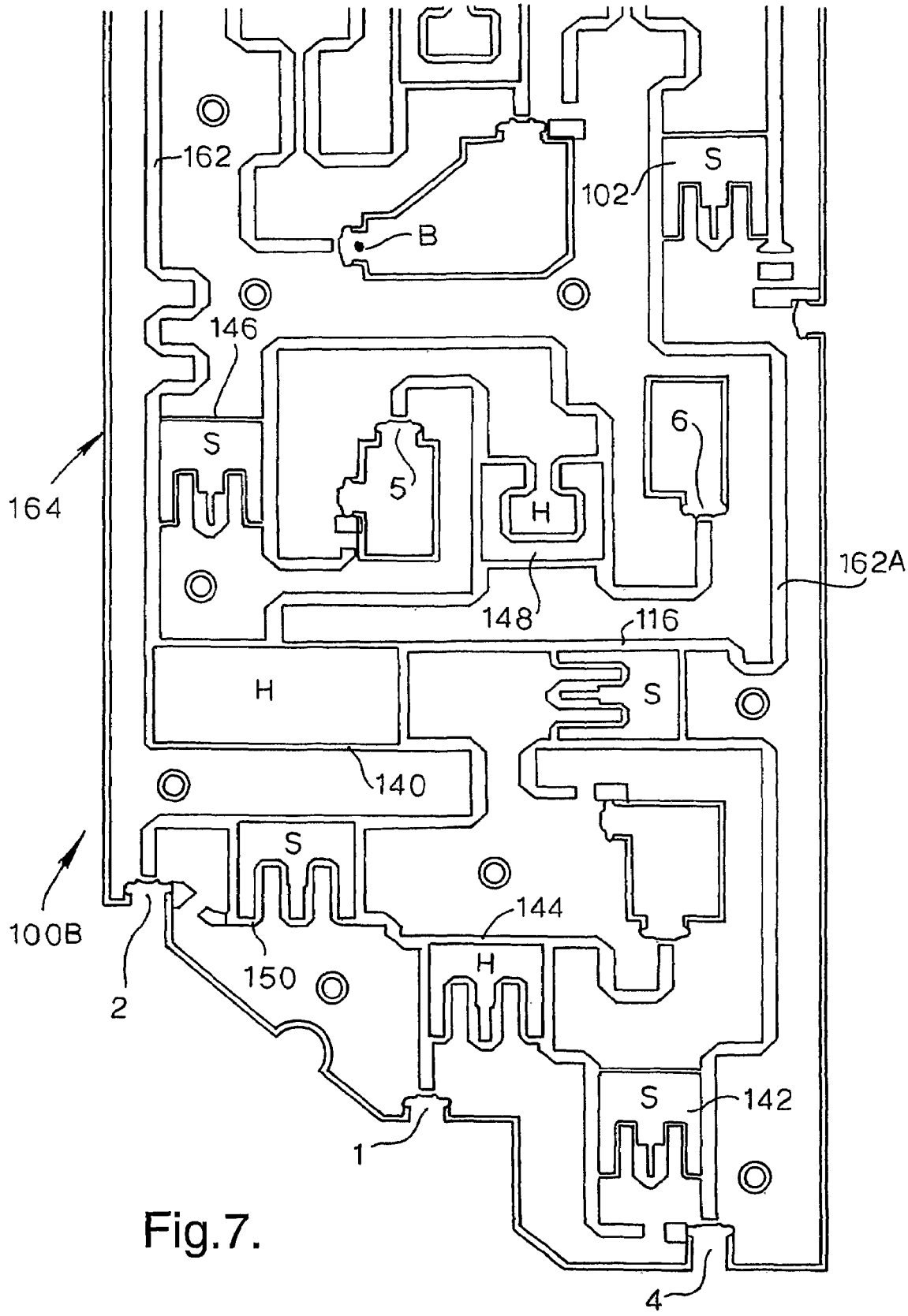

FIGS. 6 and 7 show an actual implementation of the corporate feed network 100 as a circuit board, and are respectively its upper and lower portions 100A and 100B with a little overlap. These drawings are to scale, and the network is shown 0.814 times actual size, i.e. a size reduction of ~19%, and operates at 2 GHz (microwave frequency). In FIG. 6, splitter or hybrid elements 118 and 132 to 138 have stepped meandered track sections (meandering is shown at 60 in FIG. 3); the stepping provides width changes every $\lambda/4$ along the meander track section to implement signal weighting as described earlier: here $\lambda$ is an operating wavelength of the antenna system measured in the circuit board material. The meandered track sections of stepped or different widths have differing impedance which improves power split ratios while avoiding impedance problems associated with tracks too thin or too thick: e.g. splitter 128 has a meandered track section with a wide section 128*w* and two narrow sections 128*n*. Within chain lines in each case, hybrid 120 is implemented with a re-entrant square section (as shown at 50 in FIG. 3) and hybrid 106 is rectangular (as shown at 40 in FIG. 2). Signal A input is indicated by A.

Spaces such as 170 are left for insertion of terminating resistors and meandered track sections such as 172 are provided to implement a fixed phase shift (as shown at e.g. $\mathbf{16}_1$ in FIG. 1). The meander track sections such as 172 provide paths from A and B signal input ports to antenna element output ports 1 to 12 which are phase neutral, because the meanders introduce delays or "time padding" counteracting phase differences which would otherwise occur between paths to different output ports. Separations between adjacent tracks are at least 10 mm, and circuit board mounting holes such as 174 are provided.

The conducting tracks 162B and 162A have centres which are near, i.e. 8.4 mm from, outer edges of the circuit board 164. The material of the circuit board has a dielectric constant $\in$ of 3.2, and operates at 2 GHz-free space wavelength 15 cm. The wavelength in the network 100 is therefore $15/\in^{1/2}$, i.e. 8.4 cm or 84 mm. The centres of the conducting tracks 162B and 162A therefore have a separation of $\lambda/10$ from the outer edges of the circuit board 164, where $\lambda$ is an operating wavelength of the antenna system measured in the circuit board material. If this separation is reduced appreciably, the proximity of the board edge starts to affect propagation in the conducting track sections 162B and 162A because the assumption that these tracks lie on an infinite dielectric sheet is no longer valid. If however this separation is increased too much, it begins to compromise antenna and antenna radome design. Radome size is determined by antenna size which in turn is determined by antenna elements: in the present example the antenna width is 127 mm, and the corporate feed circuit board is intended to go behind the antenna within a tubular radome. The board 164 is 130 mm across, and needs to incorporate e.g. output port 7, hybrid 120 and splitter 118 across its width with centres of conducting tracks not less than 10 mm apart. This implies a maximum separation between board edge and conducting track sections 162B and 162A of $\lambda/8$, where $\lambda$ is as defined above, or 10.5 mm.

Input and output ports A, B and 1 to 12 (signal connection points) within the circuit board area (i.e. away from edges) are implemented as cut-outs from the circuit board to facilitate the connection of jumper cables. Connection cut-outs are either at board edges or not, i.e. they may be wholly within the board and spaced apart from edges. Connection cut-outs which are not at board edges are larger than those at edges, because during assembly jumper cables are held at these cut-outs using pliers in order to solder them in place, and the cut-outs need to be sufficiently large to accommodate the pliers. There is room for pliers at board edge cut-outs without making special provision.

FIG. 7 corresponds to an inverted version of FIG. 6 and will not be described in detail. Both FIGS. 6 and 7 show paths from A and B signal input ports to antenna element output ports 1 to 12 which are rendered phase neutral using 'meander' line time padding transmission sections between hybrids to maintain correct vector addition and subtraction within the hybrids.

Figure 8:
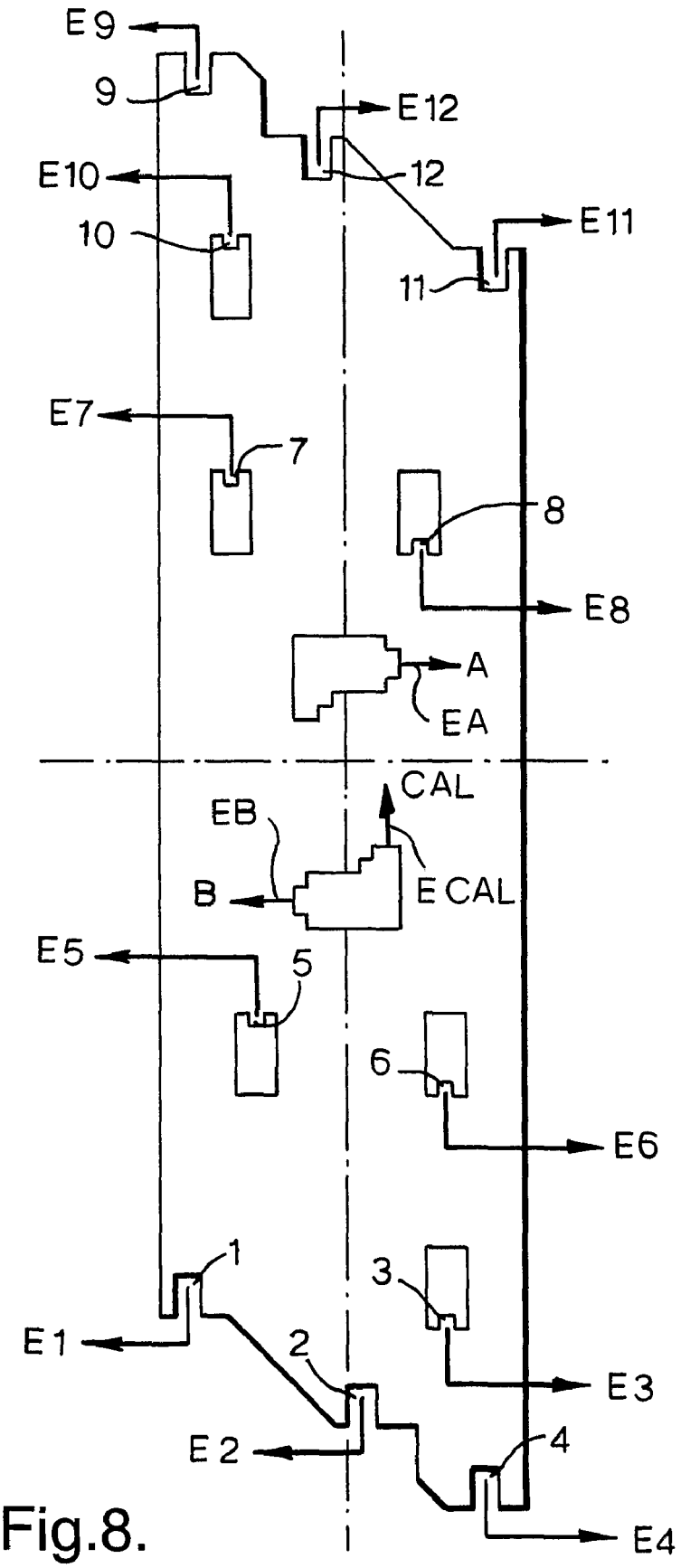
FIG. 8 Illustrates jump lead connections to the board of FIGS. 6 and 7.

FIG. 8 illustrates jumper cable connections E1 to E12 leading from output ports 1 to 12 to respective antenna elements (not shown). It also shows jumper leads EA, EB and ECAL to A and B signal sources and calibration equipment (not shown in each case). In the embodiment described with reference to FIGS. 6 to 8, a balance is struck between the (higher) track loss per unit distance on a circuit board supporting the network 100 to the loss per unit distance of the jumper cables E1 to E12 between that board and the antenna elements. Moreover, jumper lead exits from the board that are, as far as possible, in the same order as the antenna elements to which they connect. Jumper lead lengths are arranged to implement appropriate contributions to antenna element drive signal phasing.

Figure 9:
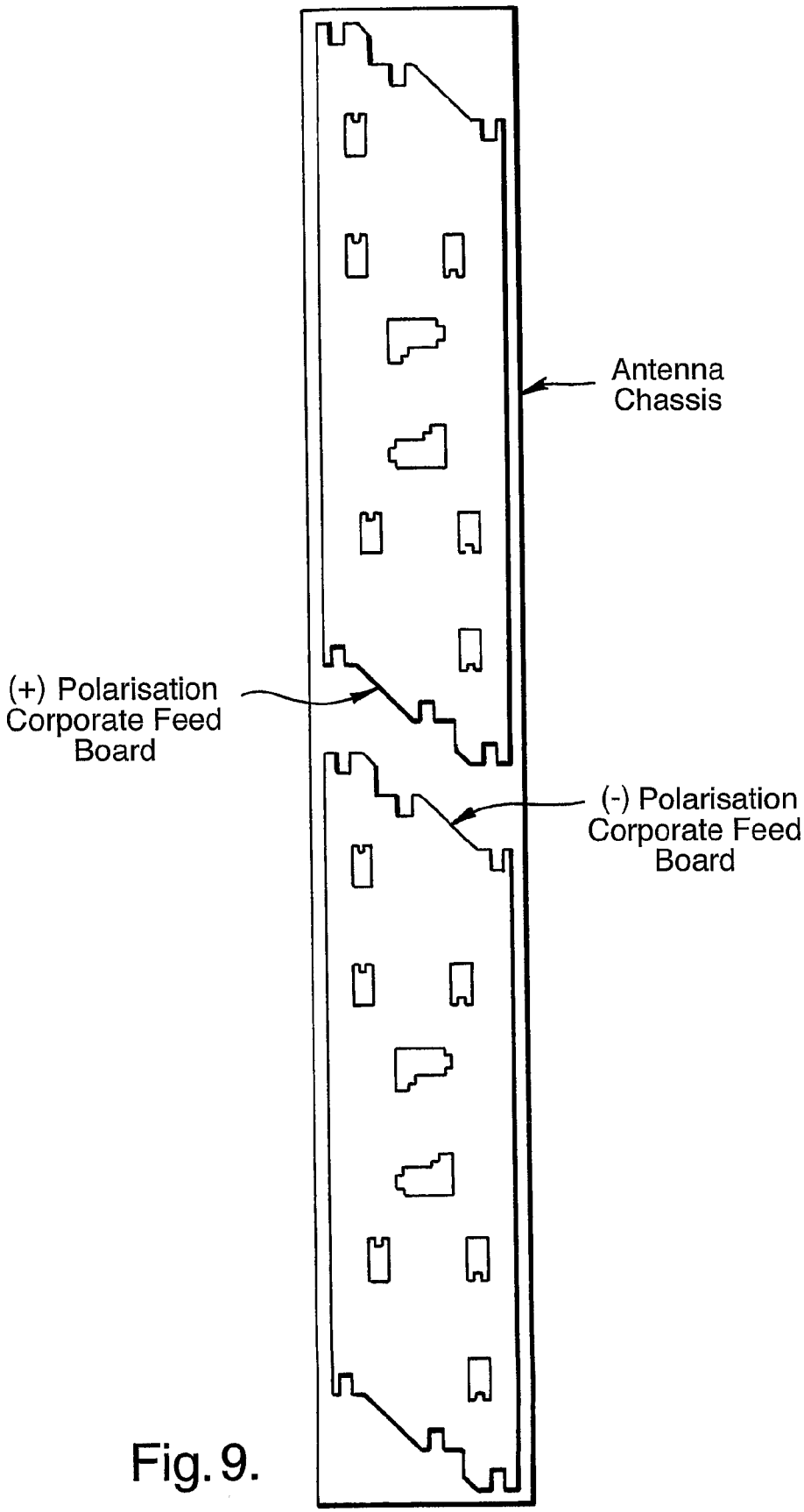
FIG. 9 shows two boards of FIGS. 6 and 7 for implementation of multiple polarisations.

FIG. 9 shows two corporate feed network boards 200(+) and 200(−) (collectively 200) each as described with reference to FIGS. 4 to 8 and mounted on a common antenna chassis 202. Board 200(+) is a corporate feed for a positive polarisation signal and 200(−) is a corporate feed for a negative polarisation signal. The two boards 200(+) and 200(−) are spaced apart to reduce coupling between them.

Figure 10:
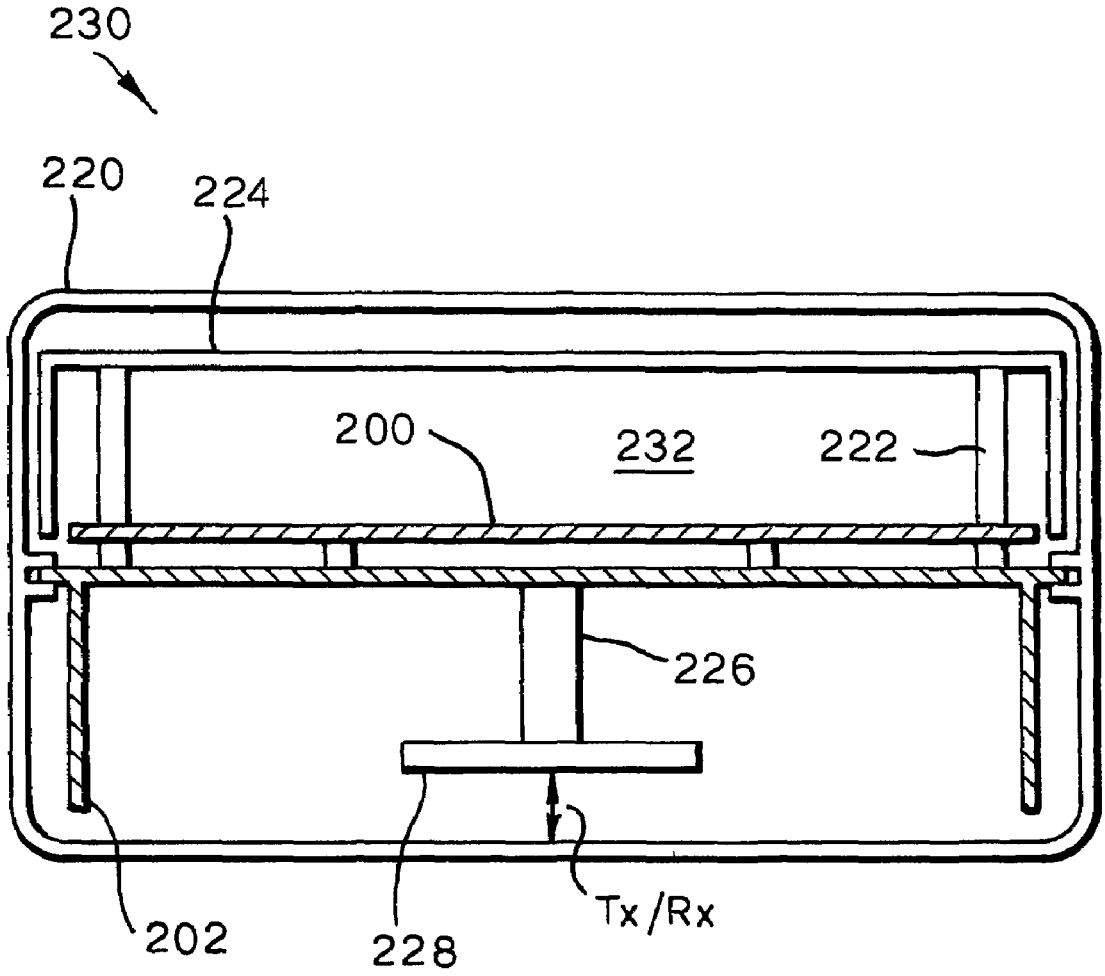
FIG. 10 is a horizontal cross-section through a radome incorporating boards of FIGS. 6 and 7.

FIG. 10 is a horizontal cross-section through a radome 220 incorporating a vertically extending corporate feed network board 200 and antenna chassis 202 as described with reference to FIG. 9. The antenna chassis 202 has a generally U-shaped section as shown. A screen support 222 spaces a rear screen 224 from the chassis 202, which is connected to a support 226 for a dipole antenna element 228. The support 226 insulates the antenna element 228 from the chassis 202, and is hollow to enable a jumper cable (not shown) to pass inside it from the network board 200 to the antenna element 228. The antenna element 228 is arranged (not shown) with a conventional "balun" to convert an unbalanced signal on a jumper cable to a signal balanced about earth as required for a dipole, and may incorporate multiple dipoles. In a dimension extending perpendicular to the plane of the drawing, the antenna chassis 202 supports multiple dipole antenna elements 228 on its forward side (which receives and/or transmits radiation) and multiple network boards 200 on its reverse side.

In order to avoid mechanical problems and board-to-board stray coupling impedances, multiple network boards 200 are not stacked upon one another. Each such board is mounted parallel to the rear screen 224 or backplane to minimise antenna depth. A single conducting screen 224 is mounted behind the network boards 200 in order to achieve a radiation front-to-back ratio of at least 25 dB. Here the expression "front" means a transmit/receive (Tx/Rx) region 230 (shown in the drawing below the radome 200) to which the antenna array radiates and from which it receives. "Back" and "behind" correspond to regions such as 232 on the side of the network board 200 remote from the antenna element 228.

The invention claimed is:

1. An electrically steerable phased array antenna system including an array of antenna elements and a corporate feed network arranged to split two input signals and vectorially combine proportions of such signals to provide antenna element signals and a beam with electrical tilt adjustable in response to varying the two input signals' phase difference, and wherein:

a) the corporate feed network has an inner region and two outer regions, the inner region being located between the two outer regions and being arranged for input of the two input signals;

b) the two outer regions are each arranged for generation of vector combinations of proportions of a respective one of the input signals plus and minus fractions of the other input signal;

c) each outer region has a respective splitting and combining network arranged to provide the said vector combinations as output signals via a respective set of antenna elements connections, each set being either mostly or wholly located peripherally around a respective one of the splitting and combining networks; and d) each splitting and combining network has respective input signal connections from the inner region disposed largely peripherally of the corporate feed network, and each splitting and combining network is arranged in combination with the input signal connections such that track cross-overs in the corporate feed network are avoided.

2. An antenna system according to claim 1 wherein the splitting and combining networks extend transversely of the corporate feed network and are longitudinally separated from the inner region.

3. An antenna system according to claim 1 wherein the splitting and combining networks have splitters and adding and subtracting elements implemented as four port couplers.

4. An antenna system according to claim 3 wherein each splitting and combining network has a respective adding and subtracting element which is rectangular and non-reentrant.

5. An antenna system according to claim 3 wherein the four port couplers are 180 degree hybrids.

6. An antenna system according to claim 5 wherein at least some of the hybrids have re-entrant or meandered track sections.

7. An antenna system according to claim 6 wherein some of the hybrid couplers have meandered track sections with widths stepped at $\lambda/4$ intervals to implement signal weighting.

8. An antenna system according to claim 6 including signal connections with meandered portions to implement fixed phase shifts.

9. An antenna system according to claim 3 wherein the splitters and adding and subtracting elements are connected by conducting tracks with centres separated by at least 10 mm from one another.

10. An antenna system according to claim 3 wherein the splitters and adding and subtracting elements are connected by conducting tracks with centres separated by at least $\lambda/8$ from one another, where $\lambda$ is an operating wavelength of the antenna system in the circuit board.

11. An antenna system according to claim 1 wherein the input signal connections to the splitting and combining networks consist predominantly of conducting tracks with centres which are distant x from respective outer edges of the circuit board, where $\lambda/10 \leqq x \leqq \lambda/8$ and $\lambda$ is an operating wavelength of the antenna system in the circuit board.

12. An antenna system according to claim 1 wherein the input signal connections to the splitting and combining networks are conducting tracks with centres which are between 8.4 mm and 10.5 mm from the outer edges of the circuit board.

13. A method of producing antenna element drive signals for an electrically steerable phased array antenna system including an array of antenna elements and a corporate feed network, the method including splitting two input signals and vectorially combining proportions of such signals to provide antenna element signals and a beam with electrical tilt adjustable in response to varying the two input signals' phase difference, and the corporate feed network having an inner region of the network located between two outer regions of the network, the method having the steps of:

a) feeding two input signals with variable relative phase to the inner region;

b) feeding respective input signals from the inner region to a respective splitting and combining network located in each of the outer regions by means of respective input signal connections disposed largely peripherally of the corporate feed network, each splitting and combining network being arranged in combination with the input signal connections such that track cross-overs in the corporate feed network are avoided; and c) generating vector combinations of proportions of one respective input signal plus and minus fractions of the other input signal in each splitting and combining network and thereby providing signals for output via a respective set of antenna elements connections, each set being either mostly or wholly located peripherally around a respective one of the splitting and combining networks.

14. A method according to claim 13 wherein the splitting and combining networks have splitters and adding and subtracting elements implemented as 180 degree hybrids at least some of which have re-entrant or meandered track sections.

* * * * *